US007255043B2

(12) United States Patent
Fischer et al.

(10) Patent No.: US 7,255,043 B2
(45) Date of Patent: Aug. 14, 2007

(54) APPARATUS AND METHOD FOR PULLING OFF SLEEVES

(75) Inventors: Stephan Fischer, Augsberg (DE); Josef Göttling, Friedberg (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 11/117,531

(22) Filed: Apr. 29, 2005

(65) Prior Publication Data

US 2005/0241518 A1 Nov. 3, 2005

(30) Foreign Application Priority Data

Apr. 30, 2004 (DE) ..... 10 2004 021 492

(51) Int. Cl.
*B41F 13/20* (2006.01)
*B41F 27/00* (2006.01)
*B41F 27/06* (2006.01)

(52) U.S. Cl. ..... 101/479; 101/480; 101/375; 101/382.1

(58) Field of Classification Search ..... 101/479–480, 101/375–378, 382.1, 389.1; 29/275
See application file for complete search history.

(56) References Cited

U.S. PATENT DOCUMENTS 1,776,194 A 9/1930 Leftwich
5,802,975 A 9/1998 Prem et al.
6,039,371 A * 3/2000 Smith ..... 294/8.6
6,250,223 B1 6/2001 Dufour
6,789,479 B2 * 9/2004 Gottling et al. ..... 101/375
2005/0081352 A1 * 4/2005 Gargiulo ..... 29/254
2006/0208142 A1 * 9/2006 Adams, IV ..... 248/206.2

FOREIGN PATENT DOCUMENTS

DE 43 41 246 C1 2/1995
DE 195 00 729 A1 7/1996
DE 100 09 705 A 1 2/2000
DE 100 44 909 A1 4/2001
DE 101 02 269 A1 8/2002
DE 102 34 329 B3 2/2004

* cited by examiner

*Primary Examiner*—Daniel J. Colilla
*Assistant Examiner*—Marissa Ferguson-Samreth
(74) *Attorney, Agent, or Firm*—24IP Law Group; Timothy R. DeWitt

(57) ABSTRACT

In an apparatus for pulling off sleeves (11, 14) which are applied to cylinders (10, 15) of a printing press, a force for pulling off the sleeve is applied in a gentle manner, in that a retaining rod (5), having a retaining head (1) which can be fixed to the sleeve (11, 14), and a hammer weight which can be moved along the rod (5) between stops (7, 9) are provided.

7 Claims, 3 Drawing Sheets

APPARATUS AND METHOD FOR PULLING OFF SLEEVES

CROSS-REFERENCE TO RELATED APPLICATIONS

This application claims priority under 35 U.S.C. § 119 to German application number 10 2004 021 492.1, filed 30 Apr. 2004, the entirety of which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The invention relates to an apparatus for pulling off sleeves which are applied to cylinders of a printing press. Sleeves are to be understood as both thin-walled printing-medium sleeves and rubber-blanket sleeves, and also thick-walled format sleeves.

2. Brief Description of the Related Art

As a result of the influences of printing operation, it occurs that a sleeve is fixed on the cylinder and can no longer be pulled off from the cylinder merely by the known introduction of compressed air. Sleeves of this type have to be released from the cylinder by force, partly by cutting them off or using rough hammer blows. As a rule, a sleeve of this type is damaged to such an extent that it cannot be used again.

SUMMARY OF THE INVENTION

Proceeding from the foregoing, one aspect of the present invention includes providing an apparatus of the aforementioned generic type, using which apparatus a force for pulling off the sleeve can be applied in a gentle manner.

According to another aspect of the present invention, this can be achieved in that a retaining rod, having a retaining head which can be fixed to the sleeve, and a hammer weight which can be moved along the retaining rod between stops, are provided. The fixing of the retaining head does not lead to any irreparable damage to the sleeve. Force pulses can then be applied to release the sleeve by rapid movements of the hammer weight against a stop, without the sleeve being exposed to direct blows from a hammer. The retaining head can optionally be fixed to the sleeve using vacuum. Fixing the retaining head in this way does not cause any marks on the sleeve.

According to a further refinement of the invention, an adhesive tape is applied which adhesively bonds the rubber lips of the retaining head which is fixed using vacuum to the sleeve. As a result, both the sealing effect of the suction space of the retaining head is improved, and the retaining force is increased.

According to another aspect of the invention, an apparatus useful for pulling off sleeves which are applied to cylinders of a printing press comprises a retaining rod having a retaining head configured and arranged to be fixed to the sleeve, and stops, and a hammer weight configured and arranged to be moved along the retaining rod between the stops.

According to another aspect of the invention, the retaining head is configured and arranged to be fixed to the sleeve using vacuum.

According to another aspect of the invention, the retaining head comprises a vacuum generator, and wherein the retaining rod comprises hollow portions configured and arranged for feeding compressed air to the retaining head vacuum generator.

According to another aspect of the invention, the apparatus further comprises a suction space on an underside of the retaining head including rubber sealing lips configured and arranged to be placed onto the sleeve, and wherein the vacuum generator is connected to the suction space.

According to another aspect of the invention, the apparatus further comprises a releasable adhesive with which the retaining head can be connected to the sleeve.

According to another aspect of the invention, the apparatus further comprises adhesive tape attaching the rubber sealing lips to the sleeve.

According to another aspect of the invention, the retaining rod comprises a handle.

According to another aspect of the invention, the apparatus further comprises a hook attached to the retaining head configured and arranged to engage behind the sleeve, for pulling off a relatively thick sleeve.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
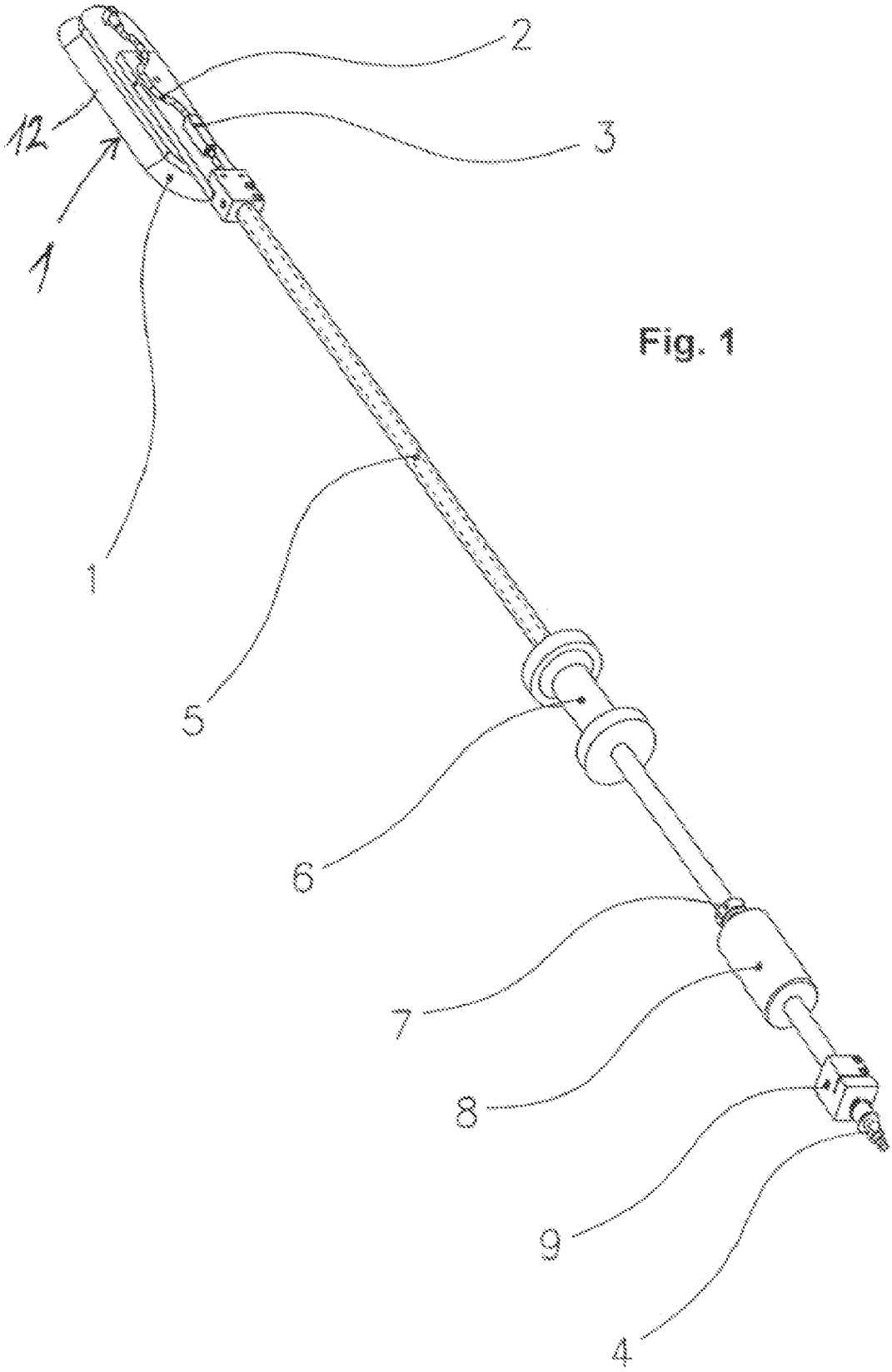
FIG. 1 illustrates a perspective view of a preferred embodiment according to the invention.

Referring to the drawing figures, like reference numerals designate identical or corresponding elements throughout the several figures.

The apparatus according to FIG. 1 has a retaining rod 5 which is provided with a handle 6. A retaining head which is designated overall by 1 is attached to one end of the retaining rod 5. The other end bears a plug-in connection 4 for the compressed air supply and a stop 9. A hammer weight 8 is attached to the retaining rod 5 in an easily displaceable manner ahead of the stop 9. Furthermore, the travel of this hammer weight 8 is limited by a stop 7 which can be set along the retaining rod 5. Furthermore, the retaining rod 5 bears a handle 6 with protective cheeks in its central region.

A vacuum generator 3 which is connected to the hollow retaining rod which conducts compressed air is attached to the retaining head 1. The vacuum generator 3 is connected via a pneumatic line 2 to a suction space which is closed off from the outside by sealing lips 12.

Figure 2:
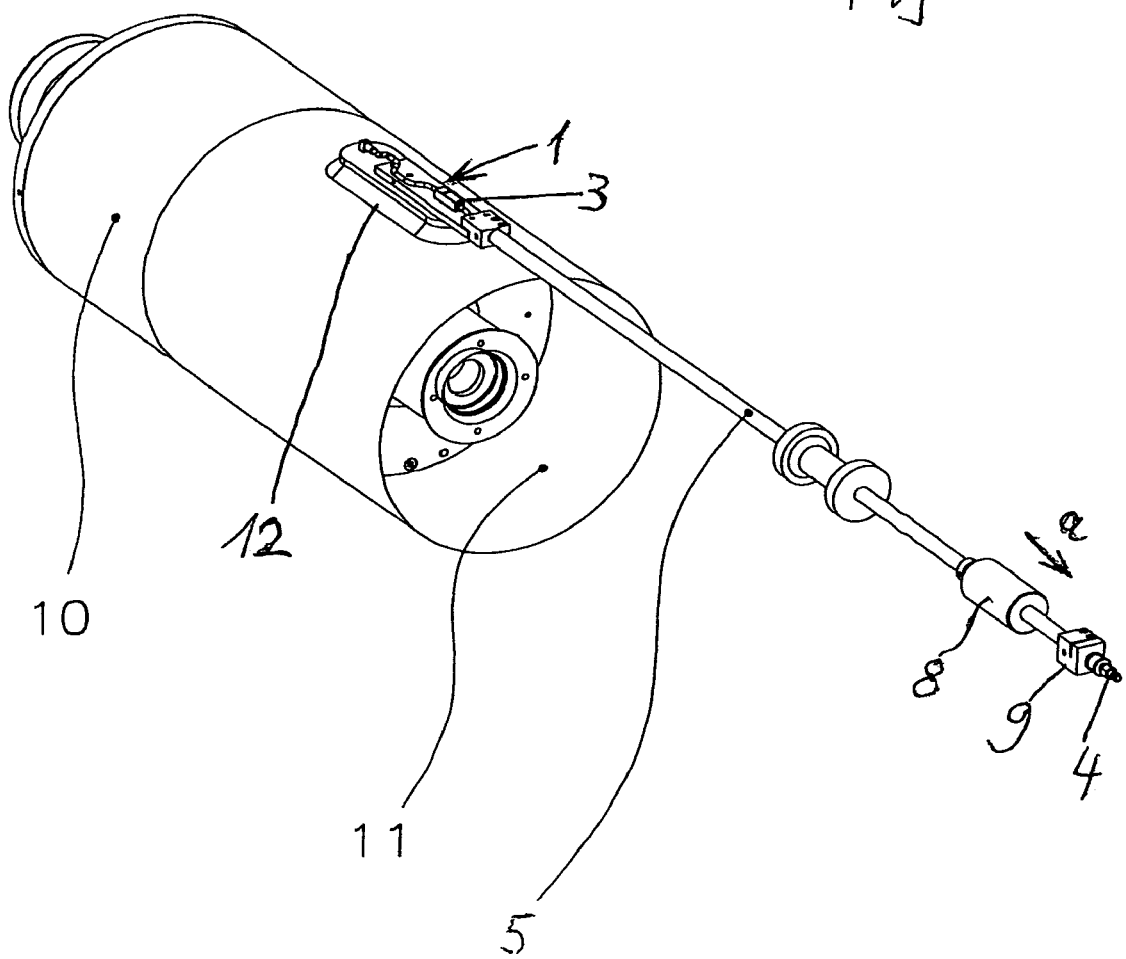
FIG. 2 illustrates the application of the apparatus according to FIG. 1.

FIG. 2 shows the apparatus according to FIG. 1 in use. Here, the retaining rod 5 is supplied with compressed air via a compressed air tube (not shown) which is connected to the plug-in connection 4. The compressed air generates a vacuum in the vacuum generator 3, which vacuum leads to the rubber lips 12 of the retaining head 1 being fixed to the sleeve 11. High force pulses are produced by the hammer weight 8 being moved against the stop 9 rapidly once or multiple times, the said force pulses leading to the sleeve 11 being released from the cylinder 10. Subsequently, the sleeve 11 can be pulled off completely by means of the retaining rod 5.

In order to increase the retaining force further between the retaining head 1 and the sleeve 11, the rubber lip 12 can be connected to the sleeve 11, for example, by means of a commercially available adhesive tape. As a result, in addition to the effect of the vacuum, the driving connection of the apparatus is improved.

Figure 3:
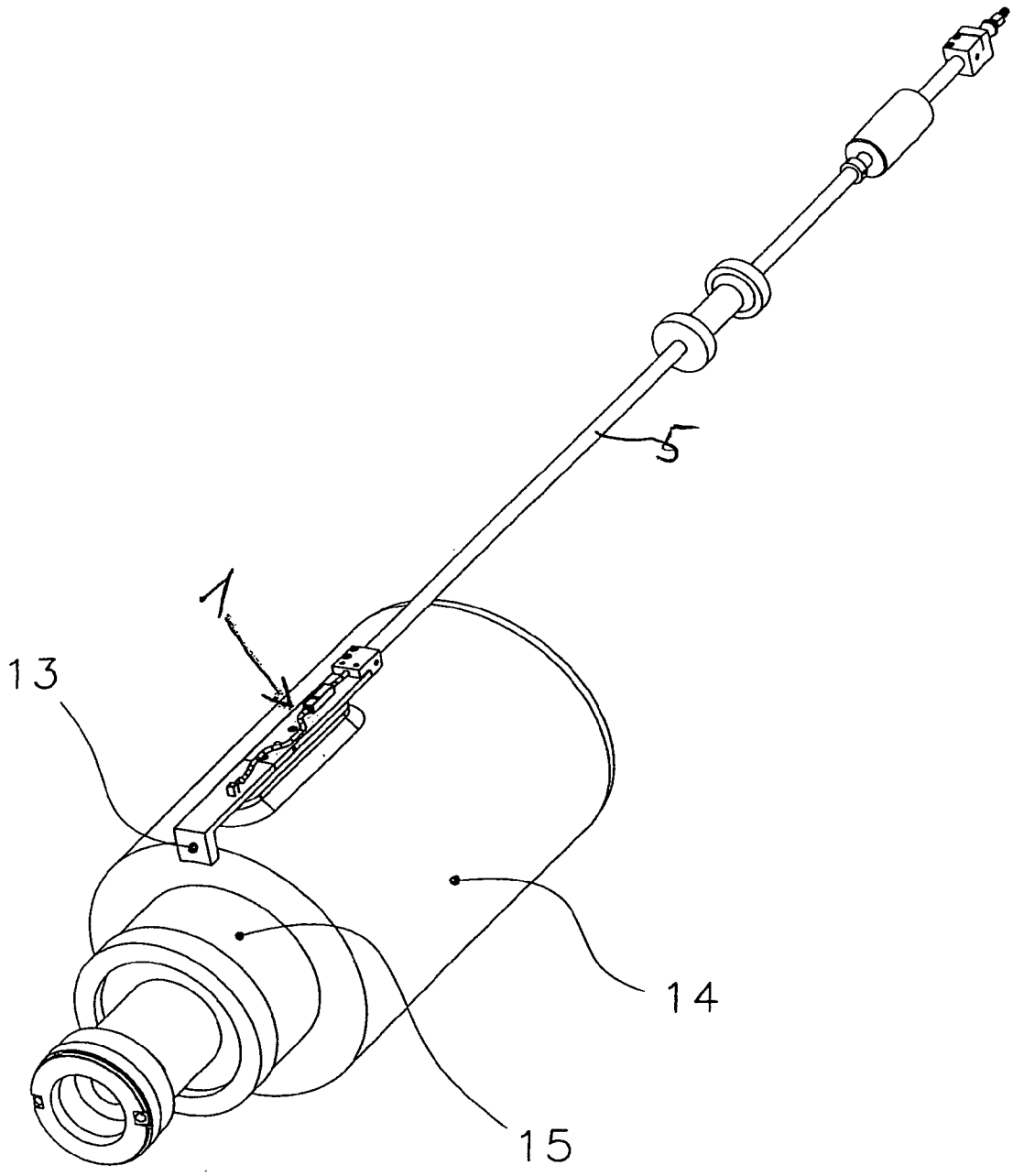
FIG. 3 illustrates a second preferred embodiment according to the invention.

In the arrangement according to FIG. 3, which shows a thick-walled sleeve 14 being released from a cylinder 15, a hook 13 is additionally attached to the retaining head 1, the angled-away end of the said hook 13 coming into contact with the rear side of the sleeve 14. As a result, the pulling-off force of the apparatus is increased further. The retaining rod 5 and the further elements which are attached to it are identical to the apparatus according to FIG. 1.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A system comprising:

a printing press cylinder having an external surface;

a sleeve mounted on the cylinder external surface, the sleeve having an external surface;

a sleeve pulling apparatus comprising:

a retaining rod having an end extending in a first direction;

a retaining head configured and arranged to be fixed to the sleeve with vacuum and stops, the retaining head oriented laterally relative to the first direction; and a hammer weight configured and arranged to be moved along the retaining rod between the stops;

wherein said retaining head of said sleeve pulling apparatus is positioned on the external surface of the sleeve.

2. A system according to claim 1, wherein the retaining head comprises a vacuum generator, and wherein the retaining rod comprises hollow portions configured and arranged for feeding compressed air to the retaining head vacuum generator.

3. An apparatus according to claim 2, further comprising:

a suction space on an underside of the retaining head including rubber sealing lips configured and arranged to be placed onto the sleeve; and wherein the vacuum generator is connected to the suction space.

4. An apparatus according to claim 3, further comprising:

adhesive tape attaching the rubber sealing lips to the sleeve.

5. A system according to claim 1, further comprising:

a releasable adhesive with which the retaining head can be connected to the sleeve.

6. A system according to claim 1, wherein the retaining rod comprises a handle.

7. A system according to claim 1, further comprising:

a hook attached to the retaining head configured and arranged to engage behind the sleeve, for pulling off a relatively thick sleeve.

* * * * *